US009311925B2

(12) United States Patent
Ojanperä

(10) Patent No.: US 9,311,925 B2
(45) Date of Patent: Apr. 12, 2016

(54) METHOD, APPARATUS AND COMPUTER PROGRAM FOR PROCESSING MULTI-CHANNEL SIGNALS

(75) Inventor: Juha Ojanperä, Nokia (FI)

(73) Assignee: Nokia Technologies Oy, Espoo (FI)

( * ) Notice: Subject to any disclaimer, the term of this patent is extended or adjusted under 35 U.S.C. 154(b) by 521 days.

(21) Appl. No.: 13/500,871

(22) PCT Filed: Oct. 12, 2009

(86) PCT No.: PCT/FI2009/050813
§ 371 (c)(1),
(2), (4) Date: Apr. 6, 2012

(87) PCT Pub. No.: WO2011/045465
PCT Pub. Date: Apr. 21, 2011

(65) Prior Publication Data
US 2012/0195435 A1 Aug. 2, 2012

(51) Int. Cl.

| | |
|---|---|
| ***G10L 19/008*** | (2013.01) |
| ***G10L 19/22*** | (2013.01) |
| ***G10L 19/02*** | (2013.01) |
| ***G10L 19/022*** | (2013.01) |
| *H04S 3/00* | (2006.01) |

(52) U.S. Cl.
CPC ..... *G10L 19/022* (2013.01); *G10L 19/008* (2013.01); *G10L 19/0212* (2013.01); *H04S 3/008* (2013.01); *H04S 2400/15* (2013.01)

(58) Field of Classification Search
CPC ..... G10L 19/008; G10L 19/022; H04S 1/00; H04S 1/02; H04S 3/00; H04S 3/02; H04S 2400/15
USPC ..... 381/17, 18; 704/500, 501
See application file for complete search history.

(56) References Cited

U.S. PATENT DOCUMENTS

| | | | | |
|---|---|---|---|---|
| 5,285,498 | A * | 2/1994 | Johnston | 381/2 |
| 5,583,784 | A * | 12/1996 | Kapust et al. | 702/77 |
| 5,765,126 | A * | 6/1998 | Tsutsui et al. | 704/200.1 |
| 8,290,782 | B2 * | 10/2012 | Shmunk | 704/500 |
| 2003/0219130 | A1 | 11/2003 | Baumgarte et al. | |
| 2007/0127566 | A1 * | 6/2007 | Schoenblum | 375/240.03 |

(Continued)

FOREIGN PATENT DOCUMENTS

WO 03107329 A1 12/2003

OTHER PUBLICATIONS

European Search Report received for Patent Application No. 09850362.6, dated Feb. 19, 2013, 3 pages.

(Continued)

*Primary Examiner* — Sonia Gay
(74) *Attorney, Agent, or Firm* — Alston & Bird LLP

(57) ABSTRACT

The invention relates to a method and an apparatus in which samples of at least a part of an audio signal of a first channel and a part of an audio signal of a second channel are used to produce a sparse representation of the audio signals to increase the encoding efficiency. In an example embodiment one or more audio signals are input and relevant auditory cues are determined in a time-frequency plane. The relevant auditory cues are combined to form an auditory neurons map. Said one or more audio signals are transformed into a transform domain and the auditory neurons map is used to form a sparse representation of said one or more audio signal.

20 Claims, 11 Drawing Sheets

(56) References Cited

U.S. PATENT DOCUMENTS

| | | | | |
|---|---|---|---|---|
| 2007/0238415 | A1 * | 10/2007 | Sinha et al. | 455/66.1 |
| 2009/0083044 | A1 | 3/2009 | Briand et al. | |

OTHER PUBLICATIONS

Shigeki Miyabe et al., "Compressive Coding of Stereo Audio Signals Extracting Sparseness Among Sound Sources with Independent Component Analysis", Applications of Signal Processing to Audio and Acoustics, 2007, IEEE Workshop ON, IEEE, PI, Oct. 1, 2007, pp. 331-334.

Chinese Office Action received for Patent Application No. 200980161903.5, dated Dec. 26, 2012, 6 pages.

Faller et al., "Binaural Cue Coding: A Novel and Efficient Representation of Spatial Audio", Media Signal Processing Research Agere Systems, Murray Hill, NJ, USA, 2002 IEEE, 4 pages.

International Search Report and Written Opinion received for PCT Patent Application No. PCT/FI2009/050813, dated Jun. 23, 2010, 15 pages.

* cited by examiner

METHOD, APPARATUS AND COMPUTER PROGRAM FOR PROCESSING MULTI-CHANNEL SIGNALS

RELATED APPLICATION

This application was originally filed as PCT Application No. PCT/FI2009/050813 filed Oct. 12, 2009.

TECHNICAL FIELD

The present invention relates to a method, an apparatus and a computer program product relating to processing multi-channel audio signals.

BACKGROUND INFORMATION

Spatial audio scene consists of audio sources and ambience around a listener. The ambience component of a spatial audio scene may comprise ambient background noise caused by the room effect, i.e. the reverberation of the audio sources due to the properties of the space the audio sources are located, and/or other ambient sound source(s) within and/or the auditory space. The auditory image is perceived due to the directions of arrival of sound from the audio sources as well as the reverberation. A human being is able to capture the three dimensional image using signals from the left and the right ear. Hence, recording the audio image using microphones placed close to ear drums is sufficient to capture the spatial audio image.

In stereo coding of audio signals two audio channels are encoded. In many cases the audio channels may have rather similar content at least part of a time. Therefore, compression of the audio signals can be performed efficiently by coding the channels together. This results in overall bit rate, which can be lower than the bit rate required for coding channels independently.

A commonly used low bit rate stereo coding method is known as the parametric stereo coding. In parametric stereo coding a stereo signal is encoded using a mono coder and parametric representation of the stereo signal. The parametric stereo encoder computes a mono signal as a linear combination of the input signals. The combination of input signals is also referred to as a downmix signal. The mono signal may be encoded using conventional mono audio encoder. In addition to creating and coding the mono signal, the encoder extracts parametric representation of the stereo signal. Parameters may include information on level differences, phase (or time) differences and coherence between input channels. In the decoder side this parametric information is utilized to recreate stereo signal from the decoded mono signal. Parametric stereo can be considered an improved version of the intensity stereo coding, in which only the level differences between channels are extracted.

Parametric stereo coding can be generalized into multi-channel coding of any number of channels. In a general case with any number of input channels, a parametric encoding process provides a downmix signal having number of channels smaller than the input signal, and parametric representation providing information on (for example) level/phase differences and coherence between input channels to enable reconstruction of a multi-channel signal based on the downmix signal.

Another common stereo coding method, especially for higher bit rates, is known as mid-side stereo, which can be abbreviated as M/S stereo. Mid-side stereo coding transforms the left and right channels into a mid channel and a side channel. The mid channel is the sum of the left and right channels, whereas the side channel is the difference of the left and right channels. These two channels are encoded independently. With accurate enough quantization mid-side stereo retains the original audio image relatively well without introducing severe artifacts. On the other hand, for good quality reproduced audio the required bit rate remains at quite a high level.

Like parametric coding, also M/S coding can be generalized from stereo coding into multi-channel coding of any number of channels. In the multi-channel case, M/S coding is typically performed to channel pairs. For example, in 5.1 channel configuration, the front left and front right channels may form a first pair and coded using a M/S scheme and the rear left and rear right channels may form a second pair and are also coded using a M/S scheme.]

There is a number of applications that benefit from efficient multi-channel audio processing and coding capability, for example "surround sound" making use of 5.1 or 7.1 channel formats. Another example that benefits from efficient multi-channel audio processing and coding is a multi-view audio processing system, which may comprise for example multi-view audio capture, analysis, encoding, decoding/reconstruction and/or rendering components. In a multi-view audio processing system a signal obtained e.g. from multiple, closely spaced microphones all of which are pointing toward different angles relative to the forward axis are used to capture the audio scene. The captured signals are possibly processed and then transmitted (or alternatively stored for later consumption) to the rendering side where the end user can select the aural view based on his/her preference from the multiview audio scene. The rendering part then provides the downmixed signal(s) from the multiview audio scene that correspond to the selected aural view. To enable transmission over the network or storage in a storage medium, compression schemes may need to be applied to meet the constraints of the network or storage space requirements.

The data rates associated with the multiview audio scene are often so high that compression coding and related processing may be needed to the signals in order to enable transmission over a network or storage. Furthermore, a similar challenge regarding the required transmission bandwidth is naturally valid also for any multi-channel audio signal.

In general, multichannel audio is a subset of a multiview audio. To a certain extent multichannel audio coding solutions can be applied to the multiview audio scene although they are more optimized towards coding of standard loudspeaker arrangements such as two-channel stereo or 5.1 or 7.1 channel formats.

For example, the following multichannel audio coding solutions have been proposed. An advanced audio coding (AAC) standard defines a channel pairwise type of coding where the input channels are divided into channel pairs and efficient psycho acoustically guided coding is applied to each of the channel pairs. This type of coding is more targeted towards high bitrate coding. In general, the psycho acoustically guided coding focuses on keeping the quantization noise below the masking threshold, that is, inaudible to human ear. These models are typically computationally quite complex even with single channel signals not to mention multi-channel signals with relatively high number of input channels.

For low bitrate coding, many technical solutions have been tailored towards techniques where small amount of side information is added to the main signal. The main signal is typically the sum signal or some other linear combination of the input channels and the side information is used to enable spatilization of the main signal back to the multichannel signal at a decoding side.

While efficient in bitrate, these methods typically lack in the amount of ambience or spaciousness in the reconstructed signal. For the presence experience, that is, for the feeling of being there, it is important that the surrounding ambience is also faithfully restored at the receiving end for the listener.

SUMMARY OF SOME EXAMPLES OF THE INVENTION

According to some example embodiments of the present invention a high number of input channels can be provided to an end user at a high quality at reduced bit-rate. When applied to a multi-view audio application, it enables the end user to select different aural views from audio scene that contains multiple aural views to the audio scene in storage/transmission efficient manner.

In one example embodiment there is provided a multi-channel audio signal processing method that is based on auditory cue analysis of the audio scene. In the method paths of auditory cues are determined in the time-frequency plane. These paths of auditory cues are called as auditory neurons map. The method uses multi-bandwidth window analysis in a frequency domain transform and combines the results of the frequency domain transform analysis. The auditory neurons map are translated into sparse representation format on the basis of which a sparse representation can be generated for the multi-channel signal.

Some example embodiments of the present invention allow creating a sparse representation for the multi-channel signals. The sparse representation itself is a very attractive property in any signal to be coded as it translates directly to a number of frequency domain samples that need to be coded. In sparse representation (of a signal) the number of frequency domain samples, also called frequency bins, may be greatly reduced which has direct implications to the coding approach: data rate may be significantly reduced with no quality degradation or quality significantly improved with no increase in the data rate.

The audio signals of the input channels are digitized when necessary to form samples of the audio signals. The samples may be arranged into input frames, for example, in such a way that one input frame may contain samples representing 10 ms or 20 ms period of audio signal. Input frames may further be organized into analysis frames which may or may not be overlapping. The analysis frames may be windowed with one or more analysis windows, for example with a Gaussian window and a derivative Gaussian window, and transformed into frequency domain using a time-to-frequency domain transform. Examples of such transforms are the Short Term Fourier Transform (STFT), the Discrete Fourier Transform (DFT), Modified Discrete Cosine Transform (MDST), Modified Discrete Sine Transform (MDST), and Quadrature Mirror Filtering (QMF).

According to a first aspect of the present invention there is provided a method comprising:

- inputting one or more audio signals;
- determining relevant auditory cues;
- forming an auditory neurons map based at least partly on the relevant auditory cues;
- transforming said one or more audio signals into a transform domain; and
- using the auditory neurons map to form a sparse representation of said one or more audio signals.

According to a second aspect of the present invention there is provided an apparatus comprising:

- means for inputting one or more audio signals;
- means for determining relevant auditory cues;
- means for forming an auditory neurons map based at least part on the relevant auditory cues;
- means for transforming said one or more audio signals into a transform domain; and
- means for using the auditory neurons map to form a sparse representation of said one or more audio signals.

According to a third aspect of the present invention there is provided an apparatus comprising:

- an input for inputting one or more audio signals;
- an auditory neurons mapping module for determining relevant auditory cues and for forming an auditory neurons map based at least partly on the relevant auditory cues;
- a first transformer for transforming said one or more audio signals into a transform domain; and
- a second transformer for using the auditory neurons map to form a sparse representation of said one or more audio signals.

According to a fourth aspect of the present invention there is provided a computer program product comprising a computer program code configured to, with at least one processor, cause an apparatus to:

- input one or more audio signals;
- determine relevant auditory cues;
- form an auditory neurons map based at least partly on the relevant auditory cues;
- transform said one or more audio signals into a transform domain; and
- use the auditory neurons map to form a sparse representation of said one or more audio signals.

DESCRIPTION OF THE DRAWINGS

In the following the invention will be explained in more detail with reference to the appended drawings, in which.

DETAILED DESCRIPTION OF THE INVENTION

Figure 1:
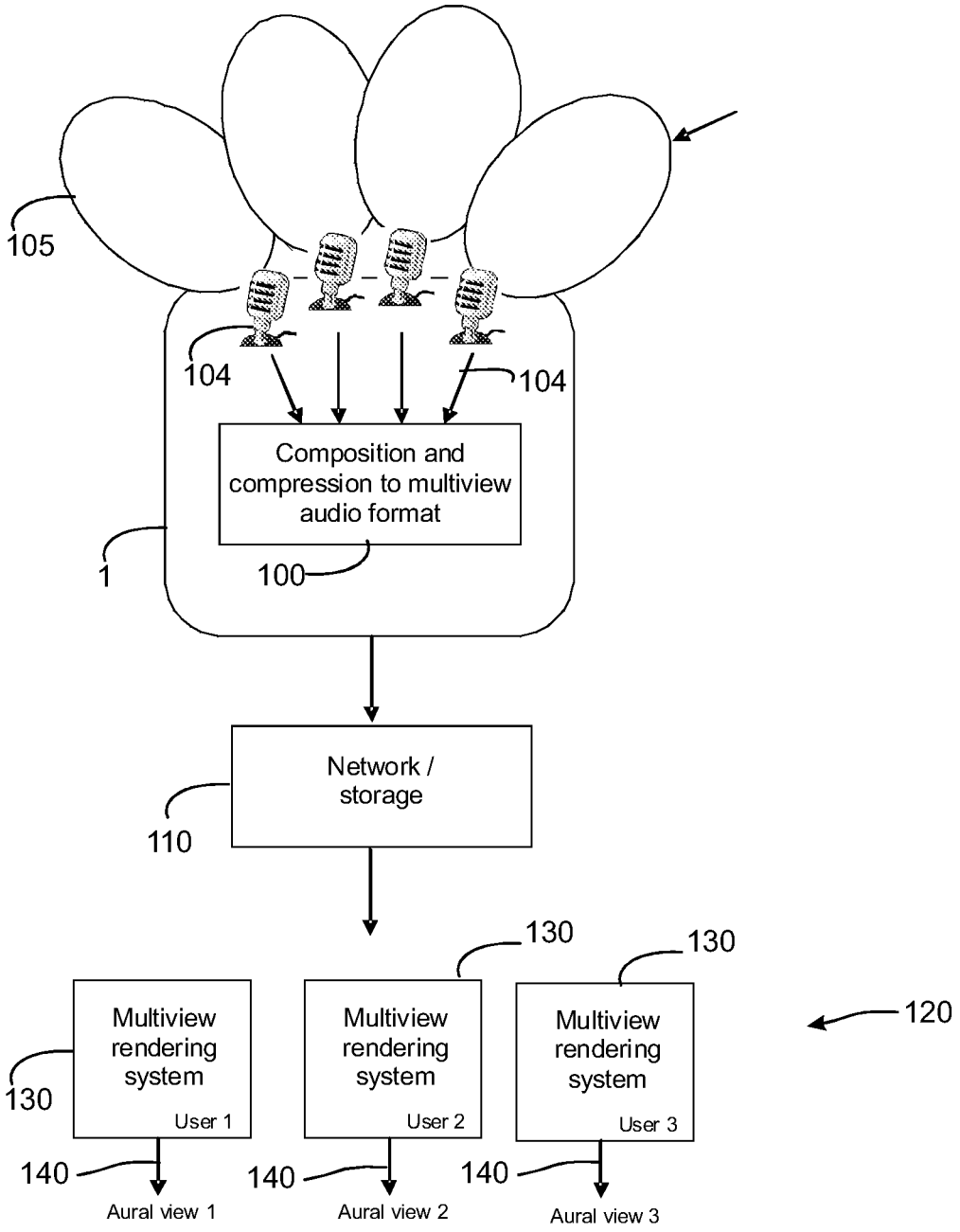
FIG. 1 depicts an example of a multi-view audio capture and rendering system.

In the following an example embodiment of the apparatuses for encoding and decoding multi-view audio signals by utilising the present invention will be described. An example of a multi-view audio capture and rendering system is illustrated in FIG. 1. In this example framework set-up, multiple, closely spaced microphones 104, all possibly pointing toward different angle relative to the forward axis, are used to record an audio scene by an apparatus 1. The microphones 104 have a polar pattern which illustrates the sensitivity of the microphone 104 to convert audio signals into electrical signals. The spheres 105 in FIG. 1 are only illustrative, non-limiting examples of the polar patterns of the microphones. The captured signals which are composed and compressed 100 to a multi-view format, are then transmitted 110 e.g. via a communication network to a rendering side 120, or alternatively stored into a storage device for subsequent consumption or for subsequent delivery to another device, where the end user can select the aural view based on his/her preference from the available multiview audio scene. The rendering apparatus 130 then provides 140 the downmixed signal(s) from the multi-microphone recording that correspond to the selected aural view. To enable transmission over the communication network 110 compression schemes may be applied to meet the constraints of the communication network 110.

It should be noted that the invented technique may be used to any multi-channel audio, not just multi-view audio in order to meet the bit-rate and/or quality constraints and requirements. Thus, the invented technique for processing the multi-channel signals may be used for, for example with two-channel stereo audio signals, binaural audio signals, 5.1 or 7.2 channel audio signals, etc.

Note that the employed microphone set-up from which the multi-channel signal originates different from the one shown in the example of FIG. 1 may be used. Examples of different microphone set-ups include a multichannel set-up such as 4.0, 5.1, or 7.2 channel configuration, a multi-microphone set-up with multiple microphones placed close to each other e.g. on a linear axis, multiple microphones set on a surface of a surface such as a sphere or a hemisphere according to a desired pattern/density, set of microphones placed in random (but known) positions. The information regarding the microphone set-up used to capture the signal may or may not be communicated to the rendering side. Furthermore, in case of a generic multi-channel signal, the signal may also be artificially generated by combining signals from multiple audio sources into a single multi-channel signal or by processing a single-channel or a multi-channel input signal into a signal with different number of channels.

Figure 7:
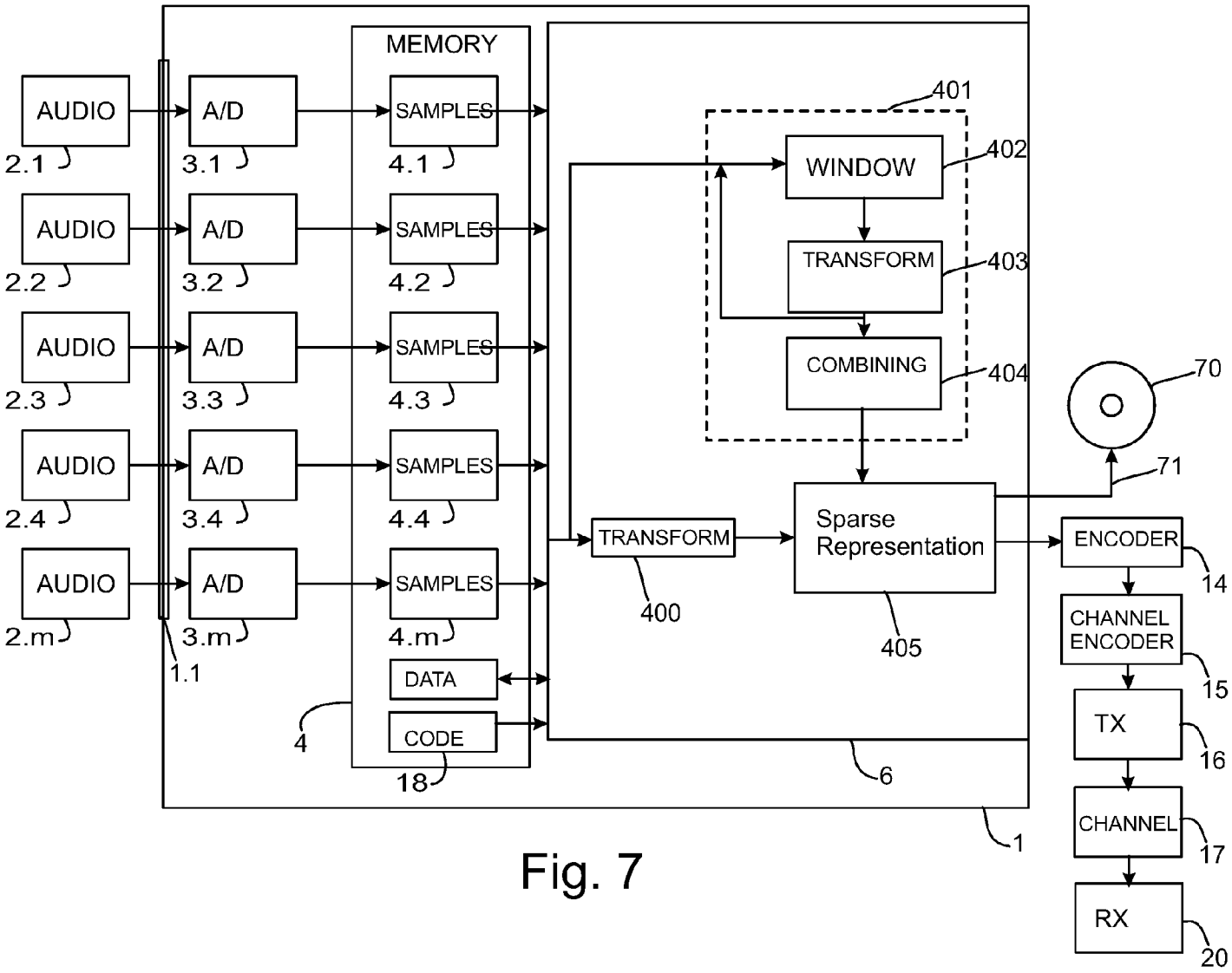
FIG. 7 depicts an apparatus for encoding multi-view audio signals according to an example embodiment of the present invention.

FIG. 7 shows a schematic block diagram of a circuitry of an example of an apparatus or electronic device 1, which may incorporate an encoder or a codec according to an embodiment of the invention. The electronic device may, for example, be a mobile terminal, a user equipment of a wireless communication system, any other communication device, as well as a personal computer, a music player, an audio recording device, etc.

Figure 2:
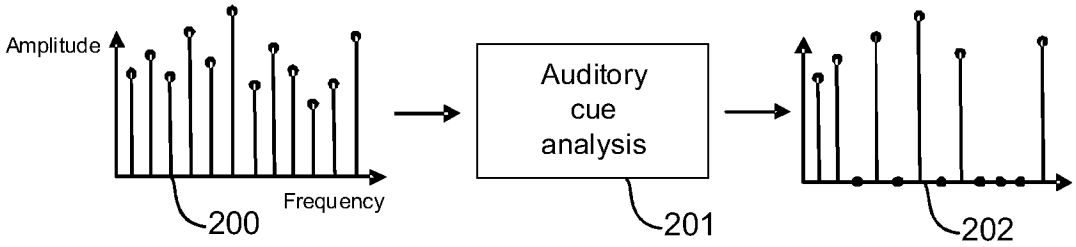
FIG. 2 depicts an illustrative example of the invention.

FIG. 2 shows an illustrative example of the invention. The plot 200 on the left hand side on FIG. 2 illustrates a frequency domain representation of a signal that has time duration of some tens of milliseconds. After applying the auditory cue analysis 201 the frequency representation can be transformed into a sparse representation format 202 where some of the frequency domain samples are changed to or otherwise marked to zero values or to other small values in order to enable savings in encoding bit-rate. Usually zero valued samples or samples having a relatively small value are more straightforward to code than non-zero valued samples or samples having a relatively large value, resulting in savings in encoded bit-rate.

Figure 3:
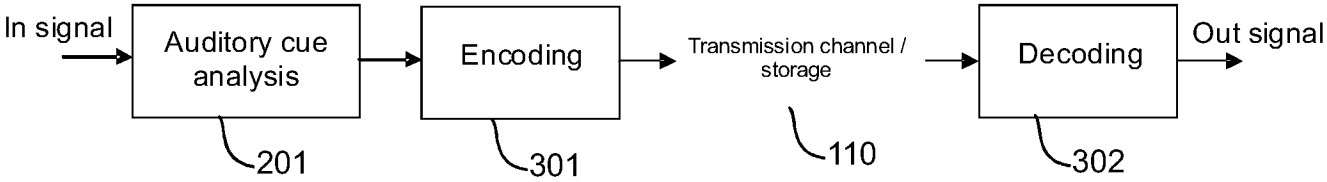
FIG. 3 depicts an example embodiment of the end-to-end block diagram of the present invention.

FIG. 3 shows an example embodiment of the invention in an end-to-end context. The auditory cue analysis 201 is applied as a pre-processing step before encoding 301 the sparse multi-channel audio signal and transmitting 110 it to the receiving end for decoding 302 and reconstruction. As non-limiting examples of the coding techniques suitable for this purpose are advanced audio coding (AAC), HE-AAC, and ITU-T G.718.

Figure 4:
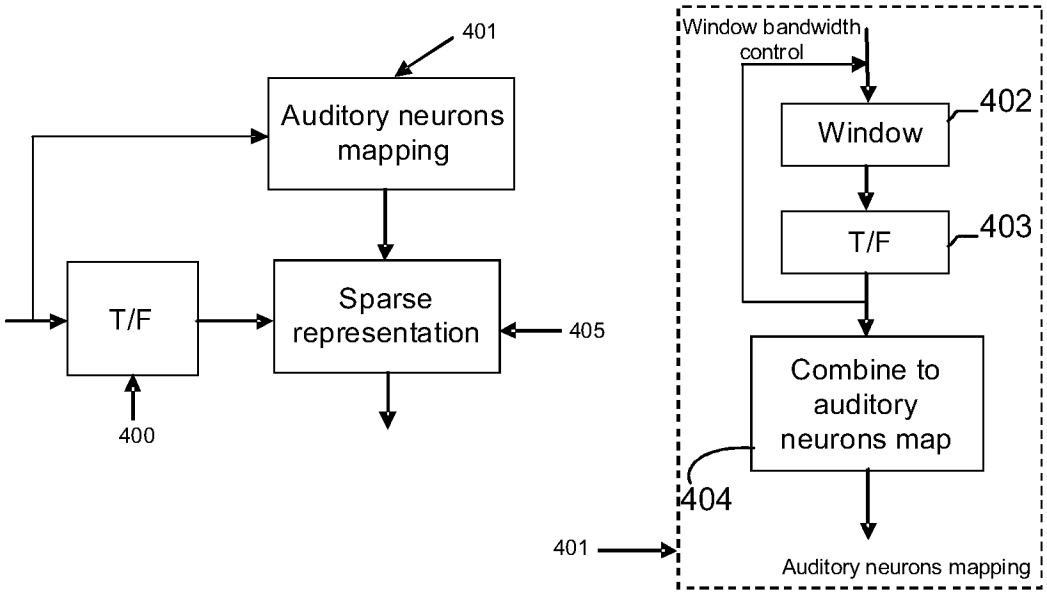
FIG. 4 depicts an example of a high level block diagram according to an embodiment of the invention.
Figure 12:
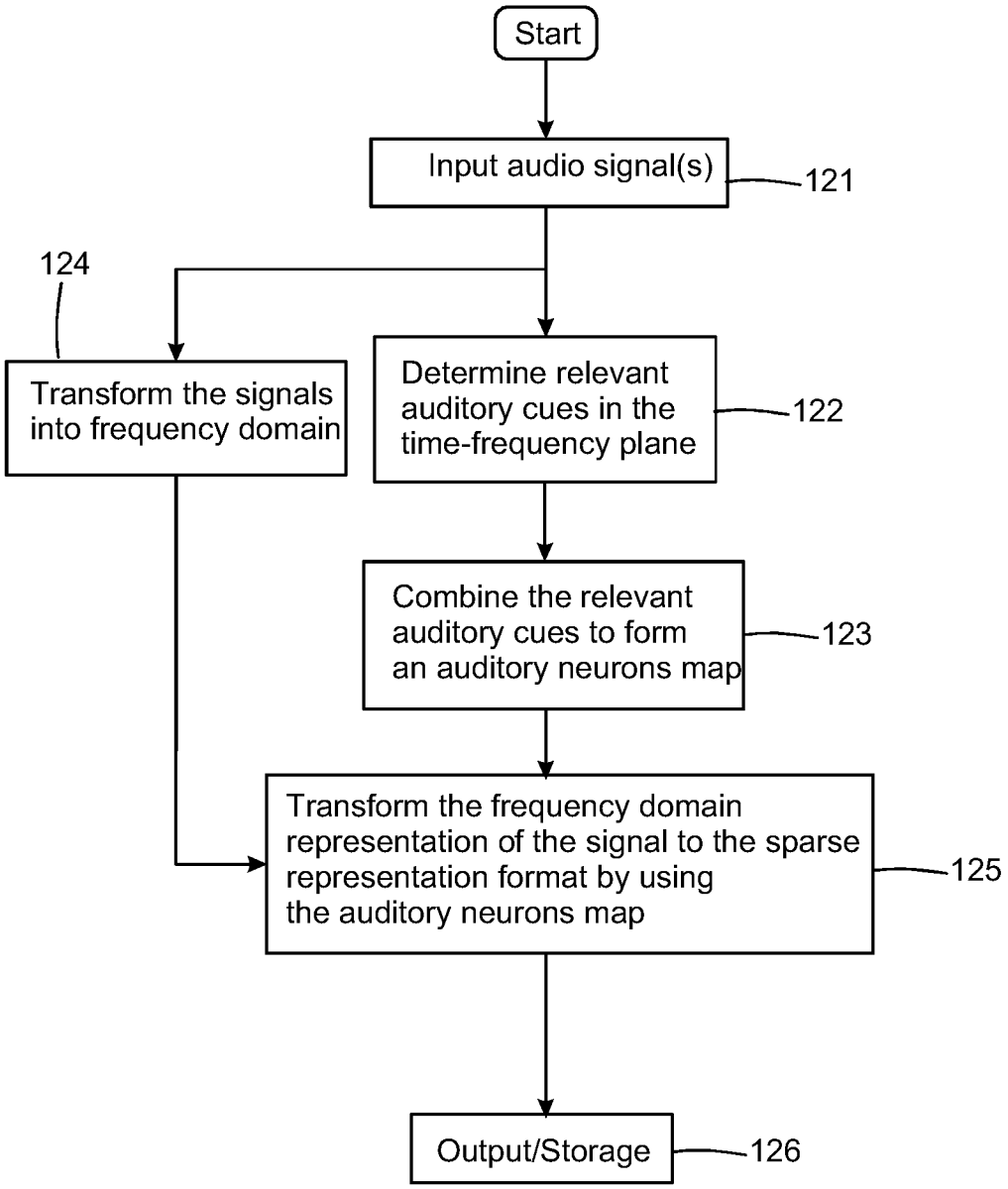
FIG. 12 depicts a flow diagram of a method according to an example embodiment of the present invention.

FIG. 4 shows the high level block diagram according to an embodiment of the invention and FIG. 12 depicts a flow diagram of a method according to an example embodiment of the present invention. First, the channels of the input signal (block 121 in FIG. 12) are passed to the auditory neurons mapping module 401, which determines the relevant auditory cues (block 122) in the time-frequency plane. These cues preserve detailed information about the sound features over time. The cues are calculated using a windowing 402 and time-to-frequency domain transform 403 techniques, e.g. Short Term Time-to-Frequency Transform STFT, employing multi-bandwidth windows. The auditory cues are combined 404 (block 123) to form the auditory neurons map, which describes the relevant auditory cues of the audio scene for perceptual processing. It should be noted that also other transforms than Discrete Fourier Transform DFT can be applied. Transforms such as Modified Discrete Cosine Transform (MDST), Modified Discrete Sine Transform (MDST), and Quadrature Mirror Filtering (QMF) or any other equivalent frequency transform can be used. Next, the channels of the input signal are converted to frequency domain representation 400 (block 124) which may be the same as the one used for the transformation of the signals within the auditory neurons mapping module 401. Using a frequency domain representation used in auditory neurons mapping module 401 may provide benefits e.g. in terms of reduced computational load. Finally, the frequency domain representation 400 of the signal is transformed 405 (block 125) to the sparse representation format that preserves only those frequency samples that have been identified important for auditory perception based at least part on the auditory neurons map provided by the auditory neurons mapping module 401.

Next, the components of FIG. 4 in accordance with an example embodiment of the invention are explained in more detail.

The windowing 402 and the time-to-frequency domain transform 403 framework operates as follows. A channel of the multi-channel input signal is first windowed 402 and the time-to-frequency domain transform 403 is applied to each windowed segment according to the following equation:

$$Y_m[k, l, wp(i)] = \left|\sum_{n=0}^{N-1} (w1_{wp(i)}[n] \cdot x_m[n + l \cdot T] \cdot e^{-j \cdot w_k \cdot n})\right| \tag{1}$$

$$Z_m[k, l, wp(i)] = \left|\sum_{n=0}^{N-1} (w2_{wp(i)}[n] \cdot x_m[n + l \cdot T] \cdot e^{-j \cdot w_k \cdot n})\right|$$

where m is the channel index, k is the frequency bin index, l is time frame index, w1[$n$] and w2[$n$] are the N-point analysis windows, T is the hop size between successive analysis windows, and $$w_k = \frac{2 \cdot \pi \cdot k}{K},$$

with K being the DFT size. The parameter wp describes the windowing bandwidth parameter. As an example, values wp={0.5, 1.0, . . . , 3.5} may be used. In other embodiments of the invention, different values and/or different number of values of bandwidth parameters than in the example above may be employed. The first window w1 is the Gaussian window and the second window w2 is the first derivative of the Gaussian window defined as $$w1_p[n] = e^{-\left(\frac{t}{sigma}\right)^2}, \quad (2)$$

$$w2_p[n] = -2 \cdot w1_p[n] \cdot \frac{t}{sigma^2},$$

$$\text{sigma} = \frac{S \cdot p}{1000},$$

$$t = -\frac{N}{2} + 1 + n$$

where S is the sampling rate of the input signal, in Hz. Equation (2) is repeated for 0≤n<N.

Figure 5B:
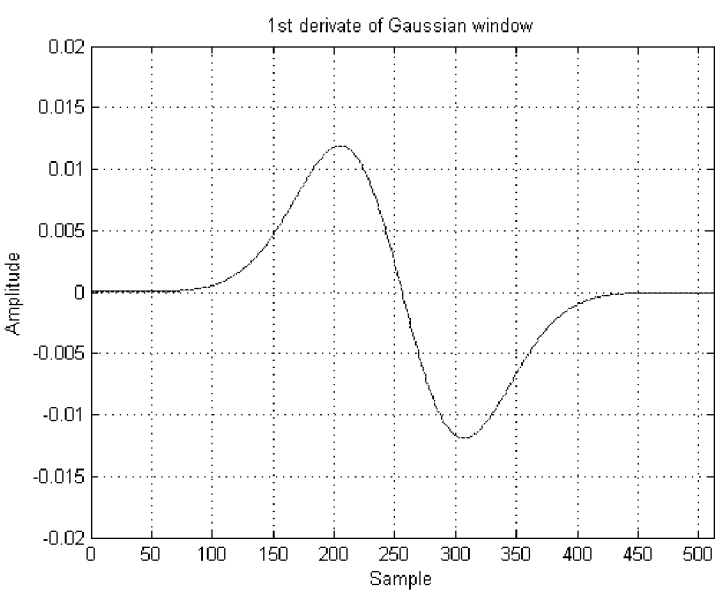
FIGS. 5*a* and 5*b* depicts an example of the Gaussian window and an example of the first derivative of the Gaussian window, respectively, in time domain.
Figure 5A:
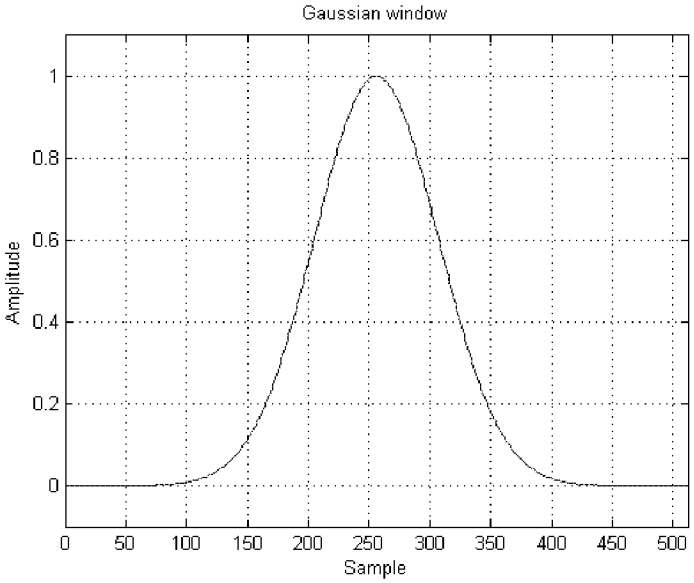
Figure 6:
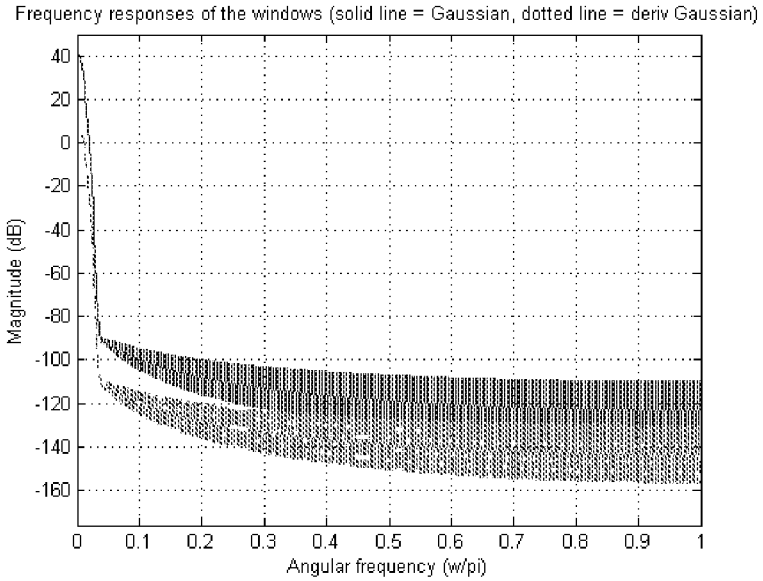
FIG. 6 depicts frequency responses of the Gaussian and the first derivative Gaussian window of FIGS. 5*a* and 5*b;*

FIGS. 5*a* and 5*b* illustrate the window functions for the first window w1 and the second window w2, respectively. The window function parameters used to generate the figures are: N=512, S=48000, and p=1.5. FIG. 6 shows the frequency response of the window of FIG. 5*a* as a solid curve and the frequency response of the window of FIG. 5*b* as a dashed curve. As can be seen from FIG. 6 the window functions have different characteristics of frequency selectivity, which is a feature that is utilized in the computation of the auditory neurons map(s).

Auditory cues may be determined using equation (1) calculated iteratively with analysis windows having different bandwidths in such a way that of each iteration round the auditory cues are updated. The updating may be performed by combining the respective frequency-domain values, for example by multiplying, determined using neighbouring values of analysis window bandwith parameter wp, and adding the combined value to the respective auditory cue value from the previous iteration round.

$$XY_m[k,l]=XY_m[k,l]+Y_m[k,l,wp(i)]\cdot Y_m[k,l,wp(i-1)]$$

$$XZ_m[k,l]=XZ_m[k,l]+Z_m[k,l,wp(i)]\cdot Z_m[k,l,wp(i-1)] \quad (3)$$

The auditory cues $XY_m$ and $XZ_m$ are initialized to zero at start up and $Y_m$[k,l,wp(−1)] and $Z_m$[k,l,wp(−1)] are also initialized to zero valued vectors. Equation (3) is calculated for 0≤i<length(wp). By using multiple bandwidth analysis windows and intersecting the resulting frequency domain representations of input signal results in improved detection of the auditory cues. The multiple bandwidth approach highlights the cues that are stable and, thus, may be relevant for perceptual processing.

Then, the auditory cues $XY_m$ and $XZ_m$ are combined to create the auditory neurons map W[k,l] for the multi-channel input signal as follows $$W[k,l]=\max(X_0[k,l],X_1[k,l], \ldots ,X_{M-1}[k,l])$$

$$X_m[k,l]=0.5\cdot(XY_m[k,l]+XZ_m[k,l]) \quad (4)$$

where M is the number of channels of the input signal and max( ) is an operator that returns the maximum value of its input values. Thus, the auditory neurons map for each frequency bin and time frame index is the maximum value of the auditory cues corresponding to the channels of the input signal for the given bin and time index. Furthermore, the final auditory cue for each channel is the average of the cue values calculated for the signal according to equation (3).

It should be noted that in another embodiment of the invention the analysis windows may be different. There may be more than two analysis windows, and/or the windows may be different from the Gaussian type of windows. As an example, the number of windows may be three, four or more. In addition, a set of fixed window function(s) at different bandwidths, such as sinusoidal window, hamming window or Kaiser-Bessel Derived (KBD) window can be used.

Figure 9:
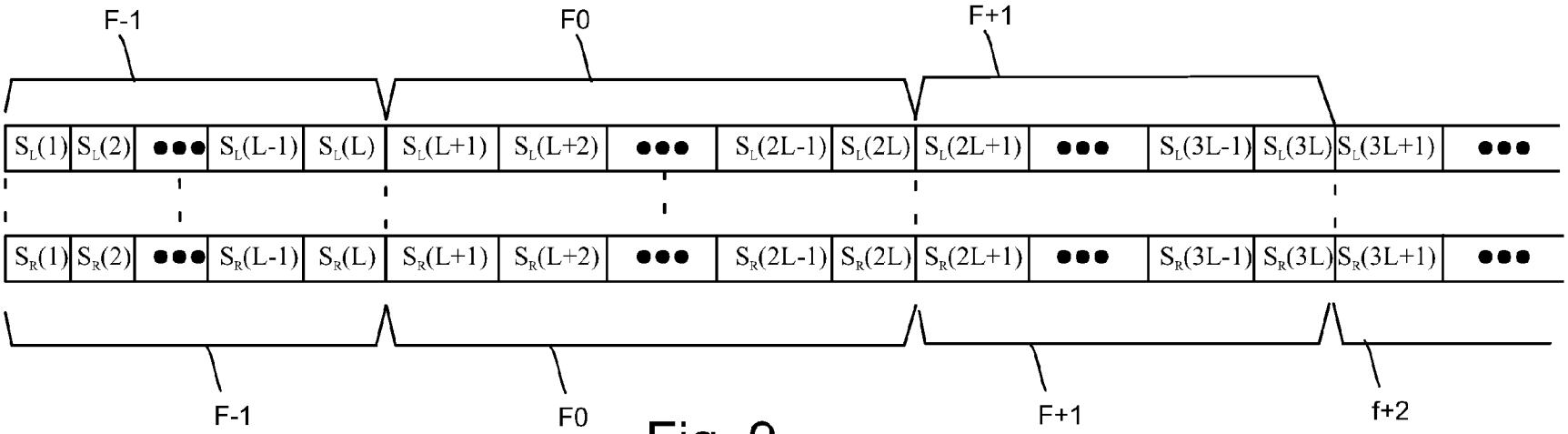
FIG. 9 depicts examples of frames of an audio signal.

Next, the channels of the input signal are converted to the frequency domain representation in the subblock 400. Let the frequency representation of the $m^{th}$ input signal $x_m$ be $Xf_m$. This representation may now be transformed into a sparse representation format in the subblock 405 as follows $$E_m[l] = \sum_{ll=l_1_start}^{l_1_end-1} \sum_{n=0}^{\frac{N}{2}-1} Xf_m[n, ll]^2 \quad (5)$$

$$thr_m[l] = \text{median}\left(W\left[0, \ldots , \frac{N}{2}-1, l_2_\text{start}\right], \ldots , W\left[0, \ldots , \frac{N}{2}-1, l_2_\text{end}\right]\right)$$

$$l_1_\text{start} = l,\ l_1_\text{end} = l_1_\text{start} + 2$$

$$l_2_\text{start} = \max(0, l-15),\ l_2_\text{end} = l_2_\text{start} + 15$$

where median( ) is an operator that returns the median value of its input values. The $E_m$[l] represents the energy of the frequency domain signal calculated over a window covering time frame indices starting from $l_1$_start and ending to $l_1$_end. In this example embodiment this window extends from the current time frame $F_0$ to the next time frame $F_{+1}$ (FIG. 9). In other embodiments, different window lengths may be employed. $thr_m$[l] represents an auditory cue threshold value for channel m, defining the sparseness of the signal. The threshold value in this example is initially set to the same value for each of the channels. In this example embodiment the window used to determine the auditory cue threshold extends from past 15 time frames to current time frame and to next 15 time frames. The actual threshold is calculated as a median of the values within the window used to determine the auditory cue threshold based on the auditory neurons map. In other embodiments, different window lengths may be employed.

In some embodiments of the invention, the auditory cue threshold $thr_m$[l] for channel m may be adjusted to take into account transient signal segments. The following pseudocode illustrates an example of this process:

```
1        r_m[l] = E_m[l] / E_m[l − 1]
2
3        if r_m[l] > 2.0 or h_m > 0
4
5          if r_m[l] > 2.0
6            h_m = 6
7            gain_m = 0.75
8            E_save_m = E_m[l]
9          end
10
11         if r_m[l] <= 2.0
12           if E_m[l] * 0.25 < E_save_m || h_m == 0
13             h_m = 0;
```

-continued

```
14            E_save_m = 0;
15          Else
16            h_m = max (0, h_m − 1);
17          End
18        End
19        thr_m[l] = gain_m * thr_m[l];
20      Else
21        gain_m = min(gain_m + 0.05, 1.5);
22        thr_m[l] = thr_m[l] * gain_m;
23      end
```

where $h_m$ and $E_save_m$ are initialized to zero, and $gain_m$ and $E_m[-1]$ are initialized to unity at start up, respectively. In line 1, the ratio between a current and a previous energy value is calculated to evaluate whether signal level increases sharply between successive time frames. If a sharp level increase is detected (i.e. a level increase exceeding a predetermined threshold value, which in this example is set to 3 dB, but other values may also be used) or if the threshold adjustment needs to be applied regardless of the level changes ($h_m$>0), the auditory cue threshold is modified to better meet the perceptual auditory requirements, i.e., the degree of sparseness in the output signal is relaxed (starting from line 3 onwards). Each time a sharp level increase is detected, a number of variables are reset (lines 5-9) to control the exit condition for the threshold modification. The exit condition (line 12) is triggered when the energy of the frequency domain signal drops a certain value below the starting level (−6 dB in this example, other values may also be used)) or when high enough number of time frames have passed (more than 6 time frames in this example embodiment, other values may also be used)) since the sharp level increase was detected. The auditory cue threshold is modified by multiplying it with the $gain_m$ variable (lines 19 and 22). In case no threshold modification is needed, as far as the sharp level increase $r_m[l]$ is concerned, the value of $gain_m$ is gradually increased to its allowed maximum value (line 21) (1.5 in this example, other values may also be used), again to improve the perceptual auditory requirements when coming out from the segment with a sharp level increase.

In one embodiment of the invention, the sparse representation, $Xfs_m$, for the frequency domain representation of the channels of the input signal is calculated according to $$Xfs_m[k, l] = \begin{cases} Xf_m[k, l], & W[k, ll] > thr_m[l] \\ 0, & \text{otherwise} \end{cases}, \quad (6)$$

$$l_0_start \le ll < l_0_end$$

$$l_0_start = \max(0, l-1),\ l_0_end = l_0_start + 2$$

Thus, the auditory neurons map is scanned for the past time frame $E_{-1}$ and present time frame $F_0$ in order to create the sparse representation signal for a channel of the input signal.

The sparse representation of the audio channels can be encoded as such or the apparatus 1 may perform a downmixing of sparse representations of input channels so that the number of audio channel signals to be transmitted and/or stored is smaller than the original number of audio channel signals.

In embodiments of the invention, sparse representation may be determined only for a subset of input channels, or different auditory neurons maps may be determined for subsets of input channels. This enables applying different quality and/or compression requirements for subsets of input channels.

Although the above described example embodiments of the invention were dealing with multi-channel signals the invention can also be applied to mono (single channel) signals, since processing according to the invention may be used to reduce the data rate allowing to possibly utilize less complex coding and quantization methods. A data reduction (i.e., the number of zero or small valued samples in the signal) between 30-60% can be achieved in an example embodiment depending on the characteristics of the audio signals.

In the following an apparatus 1 according to an example embodiment of the present invention will be described with reference to the block diagram of FIG. 7. The apparatus 1 comprises a first interface 1.1 for inputting a number of audio signals from a number of audio channels 2.1-2.*m*. Although five audio channels are depicted in FIG. 7 it is obvious that the number of audio channels can also be two, three, four or more than five. The signal of one audio channel may comprise an audio signal from one audio source or from more than one audio source. The audio source can be a microphone 105 as in FIG. 1, a radio, a TV, an MP3 player, a DVD player, a CDROM player, a synthesizer, a personal computer, a communication device, a music instrument, etc. In other words, the audio sources to be used with the present invention are not limited to certain kind of audio sources. It should also be noticed that the audio sources need not be similar to each other but different combinations of different audio sources are possible.

Signals from the audio sources 2.1-2.*m* are converted to digital samples in analog-to-digital converters 3.1-3.*m*. In this example embodiment there is one analog-to-digital converter for each audio source but it is also possible to implement the analog-to-digital conversion by using less analog-to-digital converters than one for each audio source. It may be possible to perform the analog-to-digital conversion of all the audio sources by using one analog-to-digital converter 3.1.

The samples formed by the analog-to-digital converters 3.1-3.*m* are stored, if necessary, to a memory 4. The memory 4 comprises a number of memory sections 4.1-4.*m* for samples of each audio source. These memory sections 4.1-4.*m* can be implemented in a same memory device or in different memory devices. The memory or a part of it can also be a memory of a processor 6, for example.

Samples are input to the auditory cue analysis block 401 for the analysis and to the transform block 400 for the time-to-frequency analyses. The time-to-frequency transformation can be performed, for example, by matched filters such as a quadrature mirror filter bank, by discrete Fourier transform, etc. As disclosed above, the analyses is performed by using a number of samples i.e. a set of samples at a time. Such sets of samples can also be called as frames. In an example embodiment one frame of samples represent a 20 ms part of an audio signal in time domain but also other lengths can be used, for example 10 ms.

The sparse representations of the signals can be encoded by an encoder 14 and by a channel encoder 15 to produce channel encoded signals for transmission by the transmitter 16 via a communication channel 17 or directly to a receiver 20. It is also possible that the sparse representation or encoded sparse representation can be stored into the memory 4 or to another storage medium for later retrieval and decoding (block 126).

It is not always necessary to transmit the information relating to the encoded audio signals but it is also possible to store the encoded audio signal to a storage device such as a memory card, a memory chip, a DVD disk, a CDROM, etc, from which the information can later be provided to a decoder 21 for reconstruction of the audio signals and the ambience.

The analog-to-digital converters **3.1-3.*m* may be implemented as separate components or inside the processor 6 such as a digital signal processor (DSP), for example. The auditory neurons mapping module 401, the windowing block 402, the time-to-frequency domain transform block 403, the combiner 404 and the transformer 405 can also be implemented by hardware components or as a computer code of the processor 6**, or as a combination of hardware components and computer code. It is also possible that the other elements can be implemented in hardware or as a computer code.

The apparatus 1 may comprise for each audio channel the auditory neurons mapping module 401, the windowing block 402, the time-to-frequency domain transform block 403, the combiner 404 and the transformer 405 wherein it may be possible to process audio signals of each channel in parallel, or two or more audio channels may be processed by the same circuitry wherein at least partially serial or time interleaved operation is applied to the processing of the signals of the audio channels.

The computer code can be stored into a storage device such as a code memory 18 which can be part of the memory 4 or separate from the memory 4, or to another kind of data carrier. The code memory 18 or part of it can also be a memory of the processor 6. The computer code can be stored by a manufacturing phase of the device or separately wherein the computer code can be delivered to the device by e.g. downloading from a network, from a data carrier like a memory card, a CDROM or a DVD.

Although FIG. 7 depicts analog-to-digital converters **3.1-3.*m* the apparatus 1 may also be constructed without them or the analog-to-digital converters 3.1-3.*m* in the apparatus may not be employed to determine the digital samples. Hence, multi-channel signals or a single-channel signal can be provided to the apparatus 1 in a digital form wherein the apparatus 1 can perform the processing using these signals directly. Such signals may have previously been stored into a storage medium, for example. It should also be mentioned that the apparatus 1 can also be implemented as a module comprising the time-to-frequency transform means 400, auditory neurons mapping means 401, and windowing means 402 or other means for processing the signal(s). The module can be arranged into co-operation with other elements such as the encoder 14, channel encoder 15 and/or transmitter 16 and/or the memory 4 and/or the storage medium 70**, for example.

When the processed information is stored into a storage medium 70, which is illustrated with the arrow 71 in FIG. 7, the storage medium 70 may be distributed to e.g. users who want to reproduce the signal(s) stored into the storage medium 70, for example playback music, a soundtrack of a movie, etc.

Figure 8:
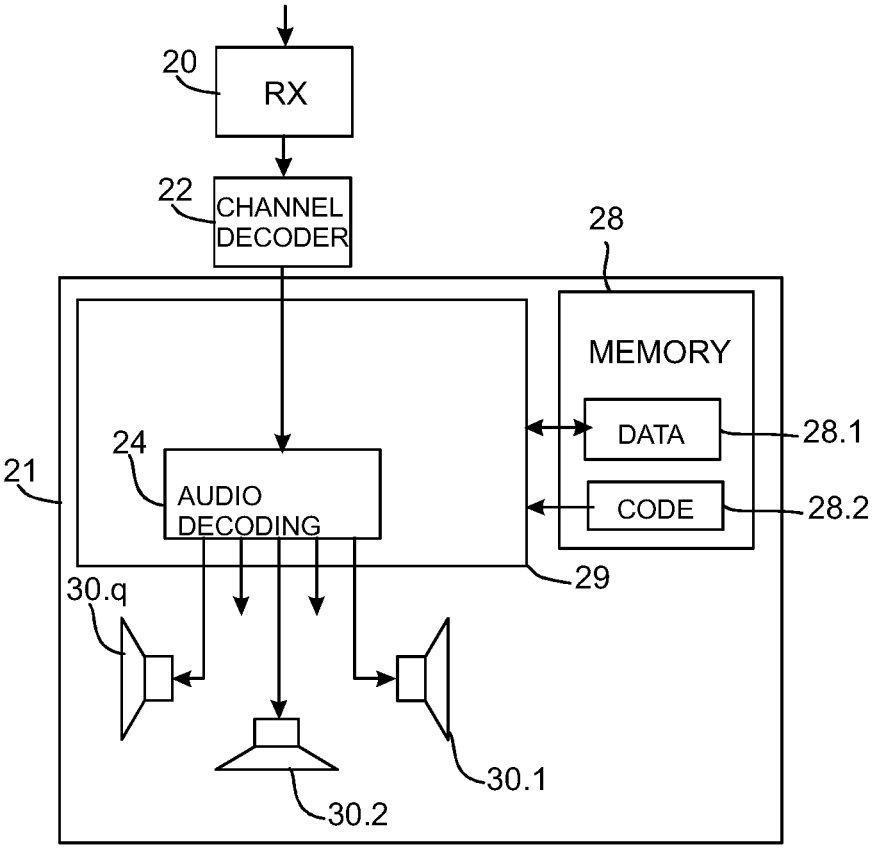
FIG. 8 depicts an apparatus for decoding multi-view audio signals according to an example embodiment of the present invention.

Next, the operations performed in a decoder 21 according to an example embodiment of the invention will be described with reference to the block diagram of FIG. 8. The bit stream is received by the receiver 20 and, if necessary, a channel decoder 22 performs channel decoding to reconstruct the bit stream(s) carrying the sparse representation of the signals and possibly other encoded information relating to the audio signals.

The decoder 21 comprises an audio decoding block 24 which takes into account the received information and reproduces the audio signals for each channel for outputting e.g. to the loudspeaker(s) 30.1, 30.2, **30.*q***.

The decoder 21 can also comprise a processor 29 and a memory 28 for storing data and/or computer code.

It is also possible that some elements of the apparatus 21 for decoding can also be implemented in hardware or as a computer code and the computer code can be stored into a storage device such as a code memory 28.2 which can be part of the memory 28 or separate from the memory 28, or to another kind of data carrier. The code memory 28.2 or part of it can also be a memory of the processor 29 of the decoder 21. The computer code can be stored by a manufacturing phase of the device or separately wherein the computer code can be delivered to the device by e.g. downloading from a network, from a data carrier like a memory card, a CDROM or a DVD.

Figure 10:
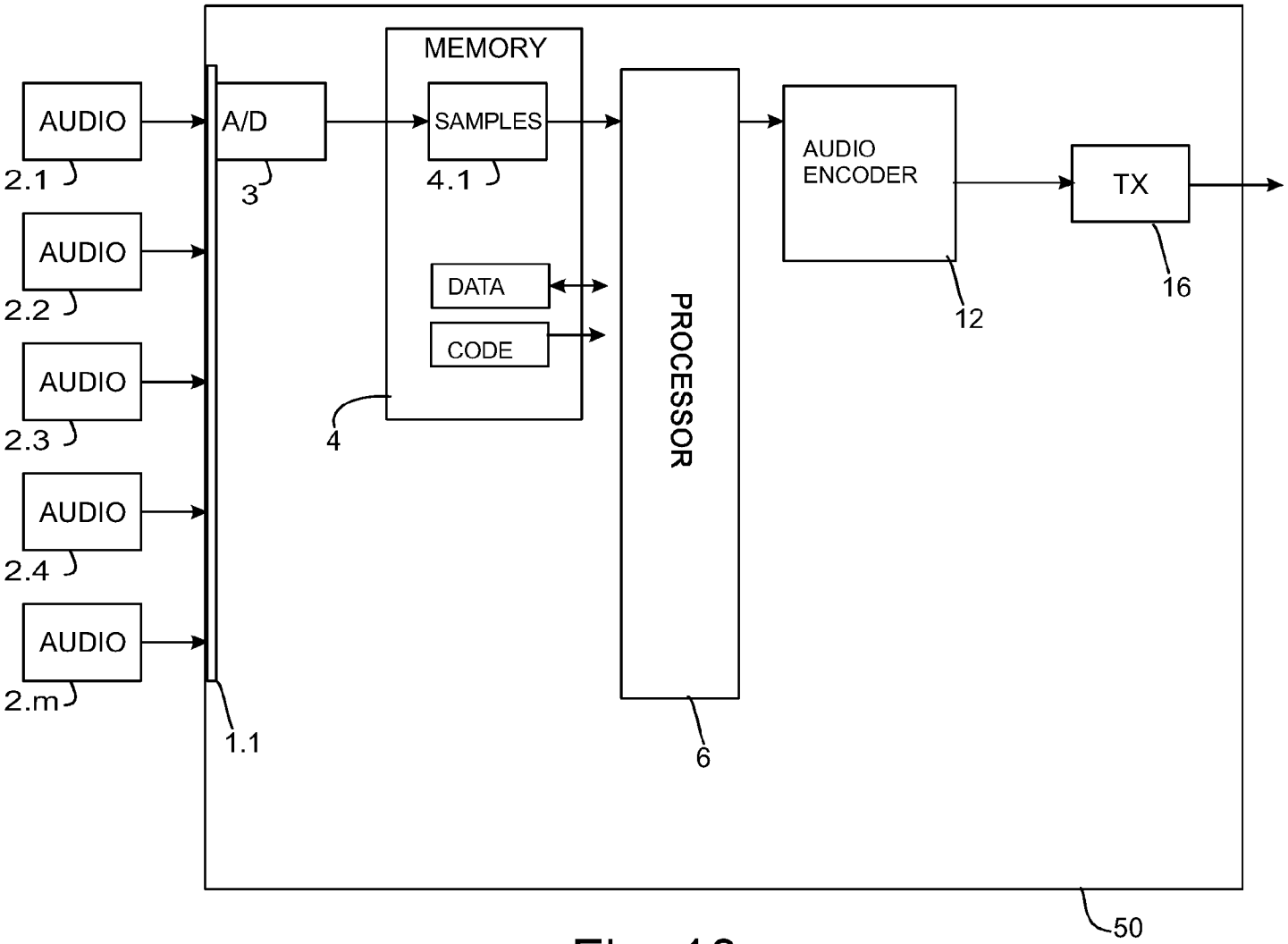
FIG. 10 depicts an example of a device in which the invention can be applied.

In FIG. 10 there is depicted an example of a device 50 in which the invention can be applied. The device can be, for example, an audio recording device, a wireless communication device, a computer equipment such as a portable computer, etc. The device 50 comprises a processor 6 in which at least some of the operations of the invention can be implemented, a memory 4, a set of inputs 1.1 for inputting audio signals from a number of audio sources **2.1-2.*m*, one or more A/D-converters for converting analog audio signals to digital audio signals, an audio encoder 12 for encoding the sparse representations of the audio signals, and a transmitter 16 for transmitting information from the device 50**.

Figure 11:
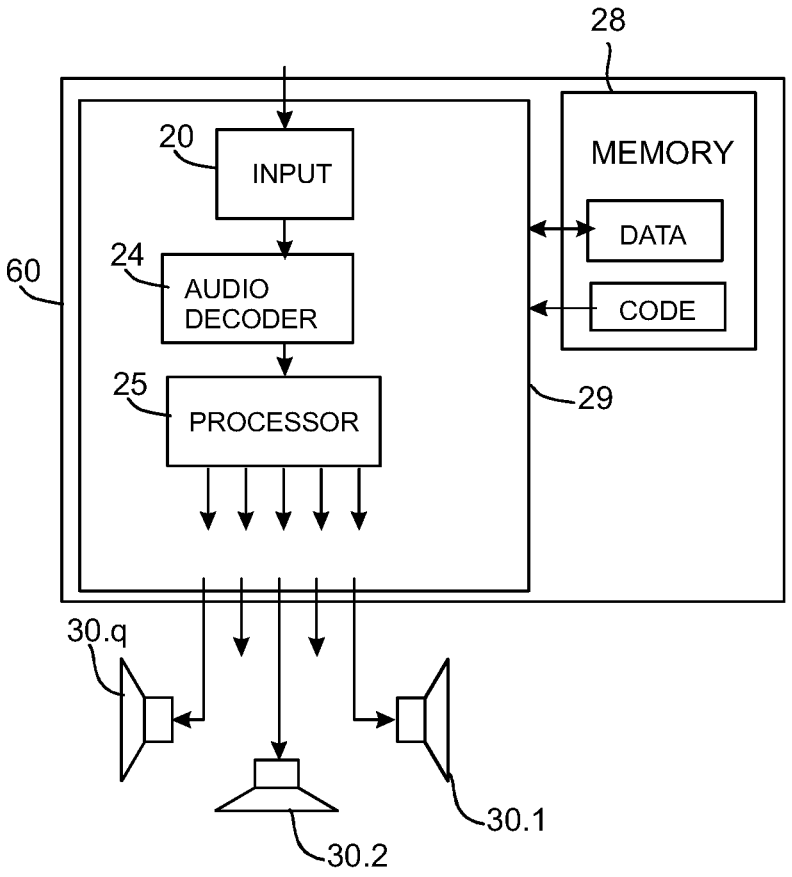
FIG. 11 depicts another example of a device in which the invention can be applied.

In FIG. 11 there is depicted an example of a device 60 in which the invention can be applied. The device 60 can be, for example, an audio playing device such as a MP3 player, a CDROM player, a DVD player, etc. The device 60 can also be a wireless communication device, a computer equipment such as a portable computer, etc. The device 60 comprises a processor 29 in which at least some of the operations of the invention can be implemented, a memory 28, an input 20 for inputting a combined audio signals and parameters relating to the combined audio signal from e.g. another device which may comprise a receiver, from the storage medium 70 and/or from another element capable of outputting the combined audio signals and parameters relating to the combined audio signal. The device 60 may also comprise an audio decoder 24 for decoding the combined audio signal, and a number of outputs for outputting the synthesized audio signals to loudspeakers **30.1-30.*q***.

In one example embodiment of the present invention the device 60 may be made aware of the sparse representation processing having taken place in the encoding side. The decoder may then use the indication that a sparse signal is being decoded to assess the quality of the reconstructed signal and possibly pass this information to the rendering side which might then indicate the overall signal quality to the user (e.g. a listener). The assessment may, for example, compare the number of zero-valued frequency bins to the total number of spectral bins. If the ratio of the two is below a threshold, e.g. below 0.5, this may mean that a low bitrate is being used and most of the samples should be set to zero to meet the bitrate limitation.

The combinations of claim elements as stated in the claims can be changed in any number of different ways and still be within the scope of various embodiments of the invention.

As used in this application, the term 'circuitry' refers to all of the following:

(a) to hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone, a server, a computer, a music player, an audio recording device, etc, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

The invention is not solely limited to the above described embodiments but it can be varied within the scope of the appended claims.

The invention claimed is:

1. A method comprising:

inputting one or more audio signals for an audio scene;

determining relevant auditory cues that preserve detailed information about sound features over time, said determining comprising:

windowing said one or more audio signals, wherein said windowing comprises first and second windowings of different bandwidths to produce a first windowed audio signal and a second windowed audio signal respectively;

transforming the first and second windowed audio signals into a transform domain; and calculating said auditory cues based on said first and second windowed audio signals;

forming an auditory neurons map comprising paths in the transform domain of the relevant auditory cues;

transforming said one or more audio signals into a transform domain;

using the auditory neurons map to form a sparse representation of said one or more transformed audio signals; and outputting said sparse representation of said one or more transformed audio signals for at least one of encoding by an encoder and storing in a storage device.

2. The method according to claim 1, wherein said first windowing comprises using two or more windows of a first type having different bandwidths, and wherein said second windowing comprises using two or more analysis windows of a second type having different bandwidths.

3. The method according to claim 2, said determining further comprising, for each of said one or more audio signals:

combining transformed windowed audio signals resulting from the first windowing; and combining transformed windowed audio signals resulting from the second windowing.

4. The method according to claim 1, said determining further comprising combining the respective auditory cues determined for each of said one or more audio signals.

5. The method according to claim 1, said using comprising determining auditory cue threshold values based on the auditory neurons map.

6. The method according to claim 5, wherein said determining auditory cue threshold values further comprises adjusting threshold values in response to a transient signal segment.

7. The method according to claim 5, wherein said sparse representation is determined based at least partly on said auditory cue threshold values.

8. The method according to claim 1 wherein said one or more audio signals comprises a multi-channel audio signal.

9. An apparatus comprising at least one processor; and at least one non-transitory memory comprising computer program code, the at least one memory and the computer program code configured to, with the at least one processor, cause the apparatus at least to:

input one or more audio signals for an audio scene;

determine relevant auditory cues that preserve detailed information about sound features over time, said determining comprising:

windowing said one or more audio signals, wherein said windowing comprises first and second windowings of different bandwidths to produce a first windowed audio signal and a second windowed audio signal respectively;

transforming the first and second windowed audio signals into a transform domain; and calculating said auditory cues based on said first and second windowed audio signals;

form an auditory neurons map comprising paths in the transform domain of the relevant auditory cues;

transform said one or more audio signals into a transform domain;

use the auditory neurons map to form a sparse representation of said one or more audio signals; and output said sparse representation of said one or more transformed audio signals for at least one of encoding by an encoder and storing in a storage device.

10. The apparatus according to claim 9, wherein said first windowing comprises using two or more windows of a first type having different bandwidths, and wherein said second windowing comprises using two or more analysis windows of a second type having different bandwidths.

11. The apparatus according to claim 10, wherein said determining further comprises the at least one memory and the computer program code configured to, with the at least one processor, cause the apparatus to, for each of said one or more audio signals:

combine transformed windowed audio signals resulting from the first windowing; and combine transformed windowed audio signals resulting from the second windowing.

12. The apparatus according to claim 9, wherein said determining further comprises the at least one memory and the computer program code configured to, with the at least one processor, cause the apparatus to combine the respective auditory cues determined for each of said one or more audio signals.

13. The apparatus according to claim 9, wherein said forming comprises the at least one memory and the computer program code configured to, with the at least one processor, cause the apparatus to determine maxima of the respective relevant auditory cues.

14. The apparatus according to claim 9, wherein said using comprises the at least one memory and the computer program code configured to, with the at least one processor, cause the apparatus to determine auditory cue threshold values based on the auditory neurons map.

15. The apparatus according to claim 14, wherein said determining auditory cue threshold values comprises the at least one memory and the computer program code configured to, with the at least one processor, cause the apparatus to determine threshold values based on median of respective values of one or more auditory neurons maps.

16. The apparatus according to claim 14, wherein said determining auditory cue threshold values further comprises the at least one memory and the computer program code configured to, with the at least one processor, cause the apparatus to adjust threshold values in response to a transient signal segment.

17. The apparatus according to claim 9, wherein said one or more audio signals comprises a multi-channel audio signal.

18. A non-transitory computer program product comprising a computer program code configured to, with at least one processor, cause an apparatus to:

input one or more audio signals for an audio scene;

determine relevant auditory cues that preserve detailed information about sound features over time, said determining comprising:

windowing said one or more audio signals, wherein said windowing comprises first and second windowings of different bandwidths to produce a first windowed audio signal and a second windowed audio signal respectively;

transforming the first and second windowed audio signals into a transform domain; and calculating said auditory cues based on said first and second windowed audio signals;

form an auditory neurons map comprising paths in the transform domain of the relevant auditory cues;

transform said one or more audio signals into a transform domain; and use the auditory neurons map to form a sparse representation of said one or more transformed audio signals; and output said sparse representation of said one or more transformed audio signals for at least one of encoding by an encoder and storing in a storage device.

19. A method according to claim 1, wherein:

said forming the auditory neurons map comprises determining paths of auditory cues in a time-frequency plane.

20. An apparatus according to claim 9, wherein said forming the auditory neurons map comprises determining paths of auditory cues in a time-frequency plane.

* * * * *